US010425759B2

(12) United States Patent
Pearson

(10) Patent No.: US 10,425,759 B2
(45) Date of Patent: Sep. 24, 2019

(54) MEASUREMENT AND CALIBRATION OF A NETWORKED LOUDSPEAKER SYSTEM

(71) Applicant: Harman International Industries, Incorporated, Stamford, CT (US)

(72) Inventor: Levi Gene Pearson, Lehi, UT (US)

(73) Assignee: Harman International Industries, Incorporated, Stamford, CT (US)

( * ) Notice: Subject to any disclaimer, the term of this patent is extended or adjusted under 35 U.S.C. 154(b) by 73 days.

(21) Appl. No.: 15/690,322

(22) Filed: Aug. 30, 2017

(65) Prior Publication Data

US 2019/0069112 A1 Feb. 28, 2019

(51) Int. Cl.

| | |
|---|---|
| ***H04S 7/00*** | (2006.01) |
| ***H04R 29/00*** | (2006.01) |
| ***H04R 1/40*** | (2006.01) |
| ***H04R 5/02*** | (2006.01) |
| ***H04R 3/00*** | (2006.01) |

(52) U.S. Cl.

CPC ..... *H04S 7/301* (2013.01); *H04R 1/406* (2013.01); *H04R 3/005* (2013.01); *H04R 5/02* (2013.01); *H04R 29/001* (2013.01); *H04R 2201/401* (2013.01); *H04R 2227/003* (2013.01); *H04R 2430/23* (2013.01); *H04S 2400/01* (2013.01); *H04S 2400/15* (2013.01)

(58) Field of Classification Search

CPC .. H04S 7/301; H04S 2400/01; H04S 2400/15; H04R 1/406; H04R 3/005; H04R 5/02; H04R 29/001; H04R 2201/401; H04R 2227/003; H04R 2430/23

USPC ..... 381/303, 56, 58, 387, 59, 122, 92, 97; 73/645

See application file for complete search history.

(56) References Cited

U.S. PATENT DOCUMENTS

| | | | | |
|---|---|---|---|---|
| 8,144,632 | B1 * | 3/2012 | Chapweske | H04N 7/15 370/238 |
| 2005/0254662 | A1 | 11/2005 | Blank et al. | |
| 2011/0002429 | A1 * | 1/2011 | Williams | H04J 3/0632 375/356 |
| 2012/0327300 | A1 * | 12/2012 | Hutchings | H04N 21/42607 348/515 |
| 2013/0003757 | A1 * | 1/2013 | Boatright | H04J 3/0697 370/474 |
| 2013/0070860 | A1 * | 3/2013 | Schramm | H04J 3/0682 375/240.25 |

(Continued)

FOREIGN PATENT DOCUMENTS

| | | | |
|---|---|---|---|
| EP | 2375779 | A3 | 1/2011 |
| EP | 2375779 | A2 | 10/2011 |

(Continued)

*Primary Examiner* — Vivian C Chin
*Assistant Examiner* — Con P Tran
(74) *Attorney, Agent, or Firm* — Angela M. Brunetti

(57) ABSTRACT

A system and method for measuring and calibrating a time-synchronized network of loudspeaker participants. Each loudspeaker participant has a plurality of microphone arrays. The system and method generates a stimulus signal at each network participant and records precise sensor data including start and end timestamps of the stimulus signal. The sensor data is compiled to estimate locations of loudspeaker participants within the time-synchronized network to establish a global frame of reference for all of the loudspeaker components in the network.

23 Claims, 4 Drawing Sheets

(56) References Cited

U.S. PATENT DOCUMENTS

| | | | | |
|---|---|---|---|---|
| 2013/0117408 | A1* | 5/2013 | Kniplitsch | H04L 67/322<br>709/217 |
| 2015/0245306 | A1* | 8/2015 | Boehlke | H04J 3/0664<br>370/350 |

FOREIGN PATENT DOCUMENTS

| | | | |
|---|---|---|---|
| EP | 3148224 | A2 | 3/2017 |
| EP | 3148224 | A3 | 6/2017 |

* cited by examiner

MEASUREMENT AND CALIBRATION OF A NETWORKED LOUDSPEAKER SYSTEM

TECHNICAL FIELD

The inventive subject mailer is directed to a system and method for measuring and calibrating a system of networked loudspeakers.

BACKGROUND

Sophisticated three-dimensional audio effects, such as those used in virtual and/or augmented reality (VR/AR) systems, require a detailed representation of an environment in which loudspeakers reside in order to generate a correct transfer function used by effect algorithms in the VR/AR systems. Also, reproducing the three-dimensional audio effects typically requires knowing, fairly precisely, the relative location and orientation of loudspeakers being used. Currently, known methods require manual effort to plot a number of recorded measurements and then analyze and tabulate results. This complicated setup procedure requires knowledge and skill, which prohibits an average consumer from self-setup and also may lead to human error. Such a setup procedure also requires expensive equipment further prohibiting the average consumer from self-setup. Alternatively, known methods resort to simple estimations, which may lead to a degraded experience.

There is a need for a networked loudspeaker platform that self-organizes into a system capable of accurate environment measurements and setup without human intervention beyond a simple request to perform a setup procedure.

SUMMARY

A network of loudspeaker components having a plurality of loudspeaker components in communication with a network interface having Audio-Video Bridging/Time Synchronized Network (AVB/TSN) capability. Each loudspeaker component in the plurality of loudspeaker components has an adjustable media clock interface, a first array of microphone elements on a first plane and a second array of microphone elements on a second plane perpendicular to the first plane. A processor having computer executable instructions for performing digital signal processing generates and records an audio signal at each loudspeaker component, beamforms recorded audio using at least one loudspeaker component, adjusts and synchronizes media clock sources, coordinates measurement procedures al each loudspeaker component, in turn, and complies results to provide a common frame of reference and time base for each loudspeaker component.

A method for measuring and calibrating a time-synchronized network of loudspeaker participants. Each loudspeaker participant has a plurality of microphone arrays. The method generates a stimulus signal at each network participant and records precise start and end timestamps of the stimulus signal. The data is compiled to estimate locations of loudspeaker participants within the time-synchronized network to establish a global frame of reference for all of the loudspeaker components in the network.

Elements and steps in the figures are illustrated for simplicity and clarity and have not necessarily been rendered according to any particular sequence. For example, steps that may be performed concurrently or in different order are illustrated in the figures to help to improve understanding of embodiments of the inventive subject matter.

DESCRIPTION OF INVENTION

While various aspects of the inventive subject mailer are described with reference to a particular illustrative embodiment, the inventive subject matter is not limited to such embodiments, and additional modifications, applications, and embodiments may be implemented without departing from the inventive subject matter. In the figures, like reference numbers will be used to illustrate the same components. Those skilled in the art will recognize that the various components set forth herein may be altered without varying from the scope of the inventive subject matter.

Figure 1:
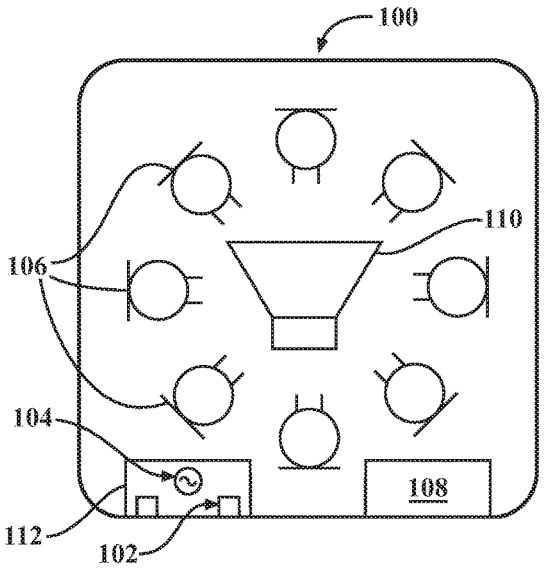
FIG. 1 is a block diagram of an exemplary loudspeaker of one or more embodiments of the inventive subject matter.

A system and method to self-organize a networked loudspeaker platform without human intervention beyond requesting a setup procedure is presented herein. FIG. 1 is a block diagram of an exemplary loudspeaker component, or participant. 100 of one or more embodiments of the inventive subject matter. A loudspeaker component 100 as used in the networked loudspeaker platform is shown in FIG. 1. The loudspeaker component 100 has a network interface 102 having Audio Video Bridging/Time Sensitive Networking capability, an adjustable media clock source 104, a microphone array 106, additional sensors 108, a speaker driver 110 and a processor 112 capable of digital signal processing and control processing. The processor 112 is a computing device that includes computer executable instructions that may be compiled or interpreted from computer programs created using a variety of programming languages and/or technologies. In general, the processor (such as a microprocessor) receives instructions, for example from a memory, a computer-readable medium or the like, and executes the instructions. The processor includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof. The instructions carried out by the processor 112 include digital signal processing algorithms for generating an audio signal, beamforming of audio recorded from the microphone array 106 and control instructions to synchronize clocks, coordinate measurement procedures, and compile results to provide a common frame of reference and time base for each loudspeaker in the network of loudspeakers. The processor 112 may be a single processor or a combination of separate control and DSP processors depending on system requirements.

The processor 112 has access to the capability, either internally or by way of internal support of a peripheral device, for digital audio output to a digital analog converter (DAC) and an amplifier that feeds the loudspeaker drivers. The digital audio output may be a pulse code modulation (PCM) in which analog audio signals are converted to digital audio signals. The processor has access to the capability, either internally or by way of internal support of a peripheral device, for PCM or pulse density modulation (PDM). The processor 112 has access to the capability, either internally or by way of internal support of a peripheral device, for precise, fine-grained adjustment of a phase locked loop (PLL) that provides a sample clock for the DAC and microphone array interface. Digital PDM microphones may run at a fixed multiple of the sample clock. The processor 110 has access to the capability, either internally or by way of internal support of a peripheral device, for high-resolution timestamp capture capability for medial clock edges. The timestamps may be accurately convertible to gPTP (generalized Precision Timing Protocol) and traceable to the samples clocked in/out at the timestamp clock edge.

The processor 112 has access to the capability, either internally or by way of internal support of a peripheral device, for one or more AVB/TSN-capable network interfaces. One example configuration includes a pair of interfaces integrated with an AVB/TSN-capable three-port switch that allows a daisy-chained set of loudspeaker components. Other examples are a single interface that utilizes a star topology with an external AVB/TSN switch, or use of wireless or other shared media AVB/TSN interfaces.

Capabilities of the AVB/TSN network interface may include precise timestamping of transmitted and received packets in accordance with the gPTP specification and a mechanism by which the integrated timer may be correlated with a high-resolution system timer on the processor such that precise conversions may be performed between any native timer and gPTP grandmaster time.

Figure 2:
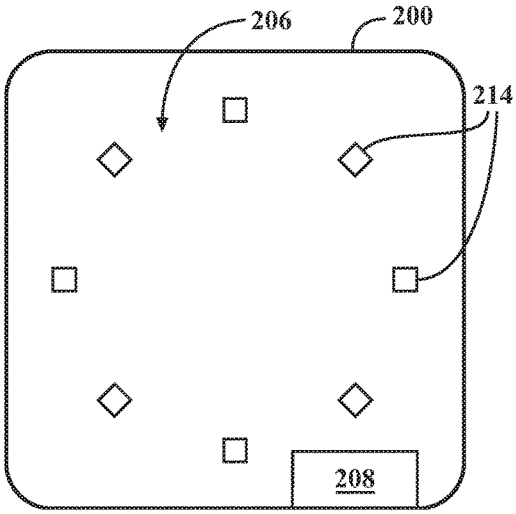
FIG. 2 is a block diagram of the exemplary loudspeaker microphone array.

FIG. 2 is a block diagram of the microphone array for one side of the loudspeaker component 200. Each loudspeaker component 200 has an array 206 of microphone elements 214 arranged in a predetermined geometric pattern, such as a circle as shown in FIG. 2. The predetermined geometric pattern is spread throughout the three-dimensional space such that beamforming algorithms are able to determine a relative heading and elevation of a recorded audio based on measurements such as a time-difference-of-arrival of a sound's wavefront at different microphone elements 214. For example, a configuration for the microphone array may be a set of sixteen total microphone elements 214. A first circle of eight elements 214 is arranged on one side, for example a top side, of the loudspeaker as shown in FIG. 2 and a second circle (not shown in FIG. 2) of eight microphone elements 214 would be located on another side of the loudspeaker, in a plane that is perpendicular to the plane, or top side as in the example shown in FIG. 2, of the first circle of microphone elements 214. It should be noted that the number of microphone elements in the array and the predetermined geometric pattern shown in FIG. 2 are for example purposes only. Variations of the number and pattern of microphone elements in the array of 206 are possible and are too numerous to mention herein. The configuration of geometric patterns and the number of microphone elements in the array may yield heading v. elevation trade-offs.

Sensors 208, in addition to the microphone elements 214, may include sensors that sense air density and distance. Because the propagation rate of sound waves in air varies based on air density, the additional sensors 208 may be included to help estimate an air density of a current environment and thereby improve distance estimations. The additional sensors 208 may be a combination of temperature, humidity, and barometric pressure sensors. It should be noted that the additional sensors 208 are for the purpose of improving distance estimations. The additional sensors 208 may be omitted based on performance requirements as compared to cost of the system.

A minimum number of loudspeaker components 200 in a network will provide measurements from the microphone arrays 206 that are sufficient for determining relative locations and orientations of the loudspeaker components in the network. Specifically, additional sensors 208 that include orientation sensors such as MEMS accelerometers, gyroscopes, and magnetometers (digital compasses) may provide valuable data points in position discovery algorithms.

Figure 3:
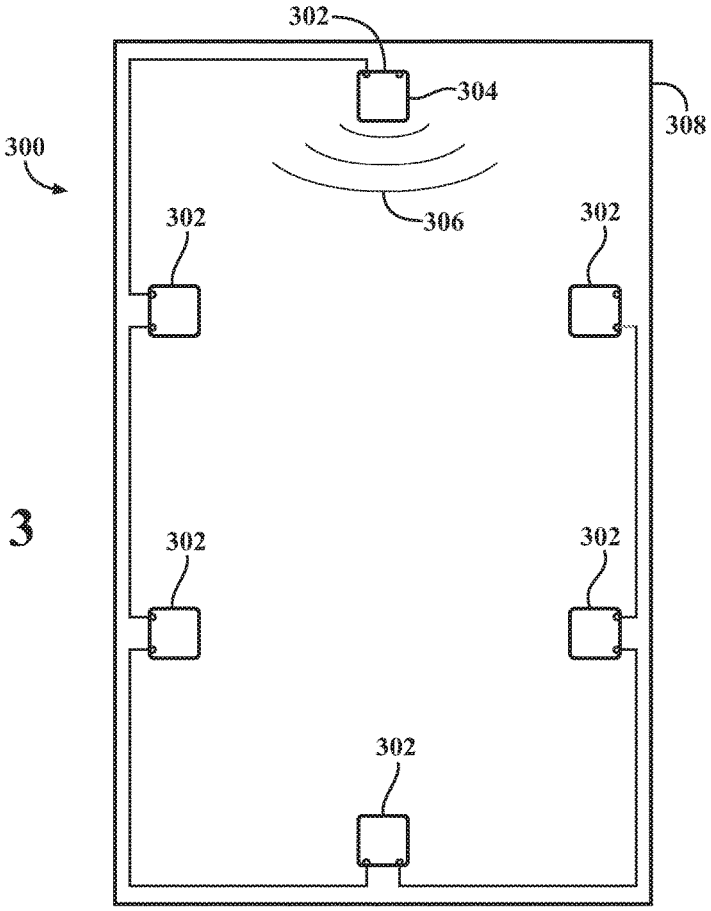
FIG. 3 is a block diagram of an exemplary network of loudspeakers.

FIG. 3 is an example of a network 300 of loudspeaker components 302 arranged around a perimeter of a room 308. One of the loudspeaker components 302 is designated as a coordinator 304. The coordinator 304 initiates a test procedure by directing at least one of the loudspeaker components 302 to generate and play a stimulus 306. The method is described in detail hereinafter.

Figure 4:
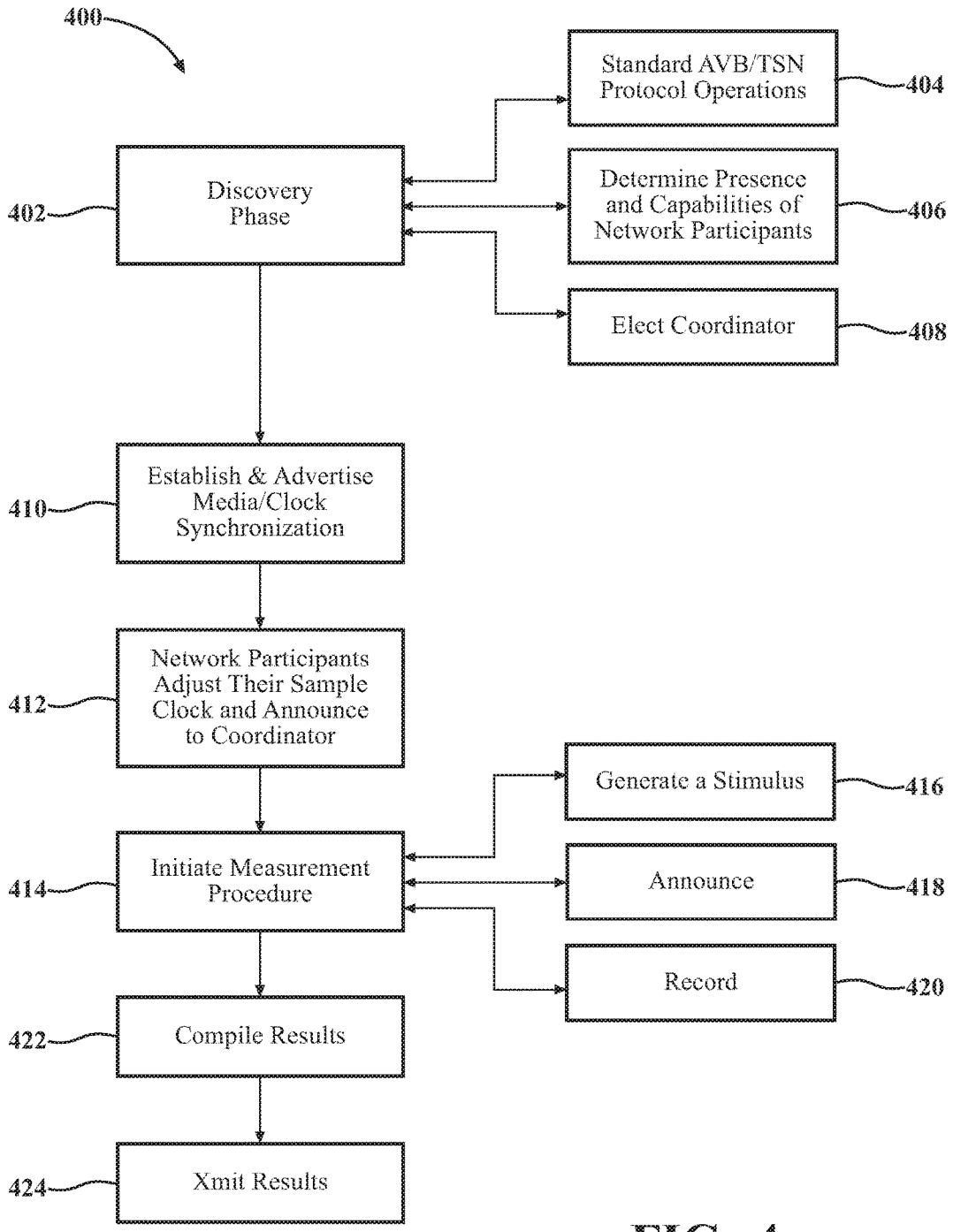
FIG. 4 is a flow chart of a method for measurement and calibration of an exemplary network of loudspeakers.

FIG. 4 is a flow chart of a method 400 for measurement and calibration of a time-synchronized network of loudspeakers with microphone arrays. Referring to FIG. 4, the method 400 begins with a discovery phase 402 that determines network peers and establishes priority. Upon power-up and detection of a network link-up event, the method enters the discovery phase. The discovery phase includes initiating standard AVB/TSN protocol operations 404, such as determining a gPTP grandmaster and Stream Reservation Protocol (SRP) domain attributes. The discovery phase also includes determining the presence and capabilities of other participants 406, (i.e., networked loudspeakers) on the network. Participants may include loudspeakers as described herein, as well as properly equipped personal computers, interactive control panels, etc. as long as they meet the requirements for AVB/TSN participation and are equipped with the computer readable instructions for the method herein.

Electing a single participant as a coordinator of the network 408 is also performed during the discovery phase 402. Election of the coordinator is based on configurable priority levels along with feature-based default priorities. For example, a device with a higher-quality media clock or more processing power may have a higher default priority. Ties in priority may be broken by ordering unique device identifiers such as network MAC addresses. In the event an elected coordinator drops off the network, a new coordinator is elected. The coordinator represents a single point of interface to the loudspeaker network.

Upon election of a coordinator 408, the coordinator establishes and advertises 410 a media clock synchronization stream on the network by way of a stream reservation protocol (SRP). Other participants (i.e., loudspeakers) are aware of the election from the election protocol and actively listen to the stream as they hear the advertisement 410. The other participants receive the sync stream and use it to adjust their own sample clock phase locked loop until it is in both frequency and phase alignment with the coordinators media clock. Once this has occurred, each participant announces their completion of synchronization to the coordinator. Once all of the participants in the network have reported their synchronization to the coordinator, the coordinator announces that the system is ready for use.

Based on a user input, such as from a control surface, a host system or another source, or based on a predetermined situation, such as a first power-on, elapsed runtime, etc., the coordinator initiates 414 a measurement procedure by announcing it to the network participants. One or more of the loudspeaker participants may generate a stimulus 416. The stimulus is an audio signal generated and played by the designated loudspeaker participants. After generation of the stimulus event, the designated loudspeaker participants announce 418 the precise time, translated to gPTP time, at which they generated the stimulus event. A stimulus will generally be generated by one loudspeaker participant at a time, but for some test procedures, the coordinator may direct multiple loudspeaker participants to generate a stimulus al the same time. The participants record 420, with precise start and end timestamps, the sensor dam relevant to the test procedure. The timestamps are translated to gPTP time.

Sensor data captured from one measurement procedure 414 may be used as input into further procedures. For example, a measurement procedure 414 may first be initiated to gather data from the sensors associated with environment and orientation. No stimulus is required for this particular measurement procedure 414, but all loudspeaker participants will report information such as their orientation, local temperature, air pressure measurements, etc. Subsequently, each loudspeaker participant in turn may be designated to create a stimulus that consists of a high-frequency sound, a "chirp", after which all other loudspeaker participants will report, to the coordinator, the timestamp al which the first response sample was recorded at each of their microphone elements. The previously gathered environment data may then be used with time difference between each stimulus and response to calculate distance from propagation time, corrected for local air pressure.

As measurement procedures are completed, results are compiled 422, first locally and then communicated to the coordinator. Depending on the measurement procedure that was requested, compilation 422 may occur both at the measurement point and at the coordinator before any reporting occurs, for example, when a loudspeaker participant records the local response to a high-frequency "chirp" stimulus, it may perform analysis of the signals, locally at the loudspeaker participant. Analysts may include beamforming of a first response signal across the microphone array to determine an angle of arrival. Analysis may also include analysis of further responses in the sample stream, indicating echo that may be subject to beamforming. The results of local analysis may be forwarded, in place of or along with, raw sample data depending on the request from the coordinator.

The results may also be compiled by the coordinator. When the coordinator receives reports from other loudspeakers, it may also perform compilation 422. For example, it may combine estimated distances and angles reported from the loudspeaker participants in the system, along with the results from orientation sensors, by way of triangulation or multilateration into a set of three-dimensional coordinates that gives the estimated locations of the loudspeakers in their environment.

Another example of compilation 422 may be for a loudspeaker to simply combine the individual sample streams from its microphone array into a single multi-channel representation before forwarding to the coordinator. The coordinator may then further compile, label, and time-align the samples it receives from each loudspeaker participant before forwarding it to a host. The host will then receive a high channel count set of data as if captures on a single multichannel recording device.

After compilation 422, the compiled results are transmitted 424. If the measurement procedure was requested by a host system and the host requested to receive the results, the coordinator will conduct the sequence of stimuli and gathering of response data required. After performing any requested compilation, the coordinator will forward the data to the host system that initiated the request and announce the system's readiness to be used for measurement or playback.

The coordinator may also store the results of a measurement procedure, either requested or automatic, for later reporting to a host system if requested so the process does not have to be re-run if the host should forget the results or a different host requests them.

Additionally, or alternatively, the loudspeaker participants may be configured with certain predefined measurement procedures, the compilation procedures of which, result in configuration data about a particular loudspeaker participants and/or the system as a whole. The procedures may be performed automatically or in response to simple user interface elements or host commands. For example, basic measurements as part of a system setup may be triggered by a simple host interface command, such as the touch of a button.

In such a case, once the coordinator has completed the sequence of stimuli and compiled the responses, it may forward the relevant data to all the loudspeaker participant in the network. The loudspeaker participants may each store this data for configuration purposes.

For example, one measurement procedure may result in a set of equalizer (EQ) adjustments and time delay parameters for each loudspeaker participant in the system. The results may form a baseline calibrated playback profile for each loudspeaker participant. Another procedure may result in three-dimensional coordinates for the loudspeaker participant's location. The coordinates may be stored and returned as a result of future queries.

As discussed above, reproducing three-dimensional audio effects requires fairly precise knowledge of relative location and orientation of loudspeaker participants used to reproduce the 3-D effects. Using the networked loudspeaker platform, with time-synchronized networking and microphone arrays, discussed above with reference to FIGS. 1-4, a method for automatically determining precise relative location of loudspeaker participants within a VR/AR room, without manual intervention, is presented herein. The combination of precise time synchronization, microphone arrays with known geometry on the loudspeaker participants, and additional orientation sensors provides adequate data to locate all of the loudspeaker participants in a relative 3-D space upon completion of the method 400. Having the precise room coordinates of the loudspeaker participants enables reproduction of 3-D audio effects and additional measurement accuracy for accomplishments such as real-time position tracking of audio sources.

Referring back to FIG. 3, the networked loudspeaker participants 302 are arranged around the perimeter of the room 308 which has an interior shape that forms a convex polygon. A direct sound propagation path between any pair of loudspeaker participants in the room is needed. While a convex polygon is represented in the present example, other shapes may be possible as long as the loudspeaker participants themselves are arranged in the form of a convex polygon and no barriers, i.e., walls, intrude into the edges of that polygon. Rooms with an unusual geometry may be accommodated by positioning the loudspeaker participants into groups (i.e., two groups) where the condition of having direct sound propagation paths between loudspeakers is met and includes at least one loudspeaker in both groups.

Figure 5:
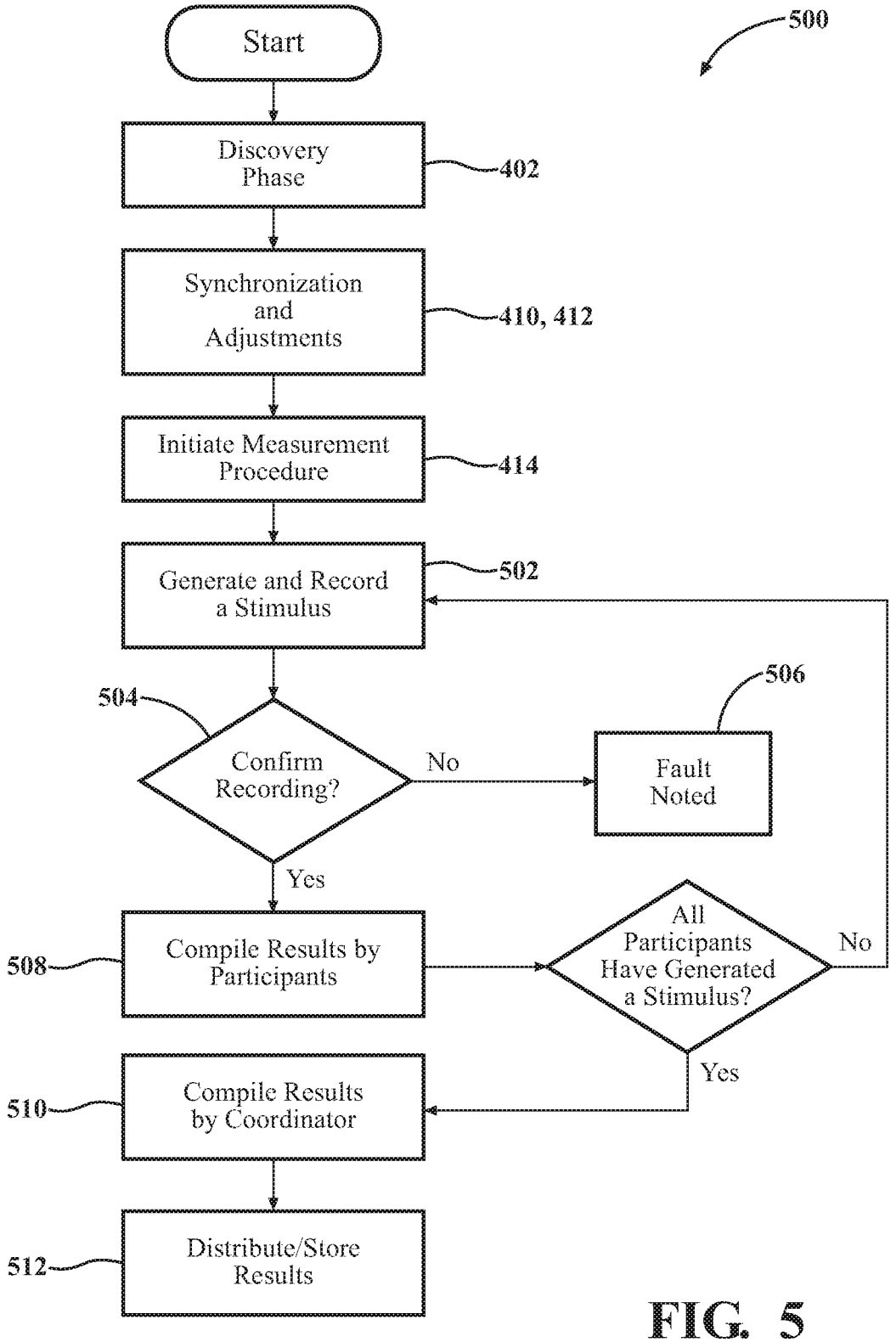
FIG. 5 is a flow chart of a method for automatic speaker placement discovery for an exemplary network of loudspeakers.

Referring now to FIG. 5 a flowchart representing a method 500 for automatic loudspeaker participant discovery is described. A stimulus is generated and recorded 502. Each loudspeaker component, or loudspeaker participant, in the network, in turn, emits a signal, such as an audio signal, that is measured simultaneously by all the loudspeaker participants in the network. An acceptable signal needs to be such that the microphone arrays are sensitive to it and the loudspeakers are capable of producing it. For example, the signal may be in the ultrasonic range. In general, any monochromatic sound pulse at a frequency near an upper end of a range that is resolvable by the system would be acceptable. The precise time of the stimulus signal is provided by the coordinator, and ail loudspeaker participants begin recording samples from their microphone arrays at that time. The loudspeaker participant responsible for generating the stimulus also records so that any latency between the instruction to generate the stimulus and the actual sound emission of the stimulus by the loudspeaker participant may be subtracted. The loudspeaker participant responsible for generating the stimulus sends out, to the other loudspeaker participants, the precise timestamp of the first audio sample in which it records the stimulus sound. The other participants in the system continue recording 502 until the stimulus signal has been recorded by all of the microphone elements in the microphone arrays 504. Failure to record a sound is indicative of a system fault 506. Therefore, should a sufficient amount of time pass without a confirmed recording, a system fault may be identified.

The recorded data is compiled by the recording devices 508. Each loudspeaker participant determines the difference between the timestamp of the first recorded sample of the stimulus signal and the timestamp received from the loudspeaker participant the generated the stimulus signal. This difference represents a time in flight, or the time that the stimulus sound wave took to propagate through the air to the recording microphones in loudspeaker participant receiving the stimulus signal. The time in flight value is converted to u distance between transmitter (the loudspeaker participant that generated the stimulus) and receiver (the loudspeaker that received and recorded the stimulus) by multiplying it by a propagation rate of sound in air.

As discussed above with reference to FIG. 2, each loudspeaker participant has its microphone arrays arranged in perpendicular planes. A first microphone array is on a plane which may be parallel to a ceiling and room of a floor. A second microphone array is on a plane perpendicular to the first microphone array. In the event the loudspeaker participant is tilted, corrections may be made to the measurements. For example, a loudspeaker participant with an additional sensor, such as an accelerometer, is capable of measuring a gravity vector direction with respect to the array that is parallel to the ceiling or floor of the room and the second array is known to be perpendicular thereto.

Using a beamforming algorithm, such as a classical delayed sum beamformer, an angle of arrival may be determined in each microphone array plane. This yields 3D azimuth and elevation measurements relative to a facing direction of the loudspeaker participant. The loudspeaker participants absolute facing is not yet known, but if the loudspeaker participant is equipped with the additional sensor that is a digital compass, that may be used to estimate absolute facing.

Figure 6:
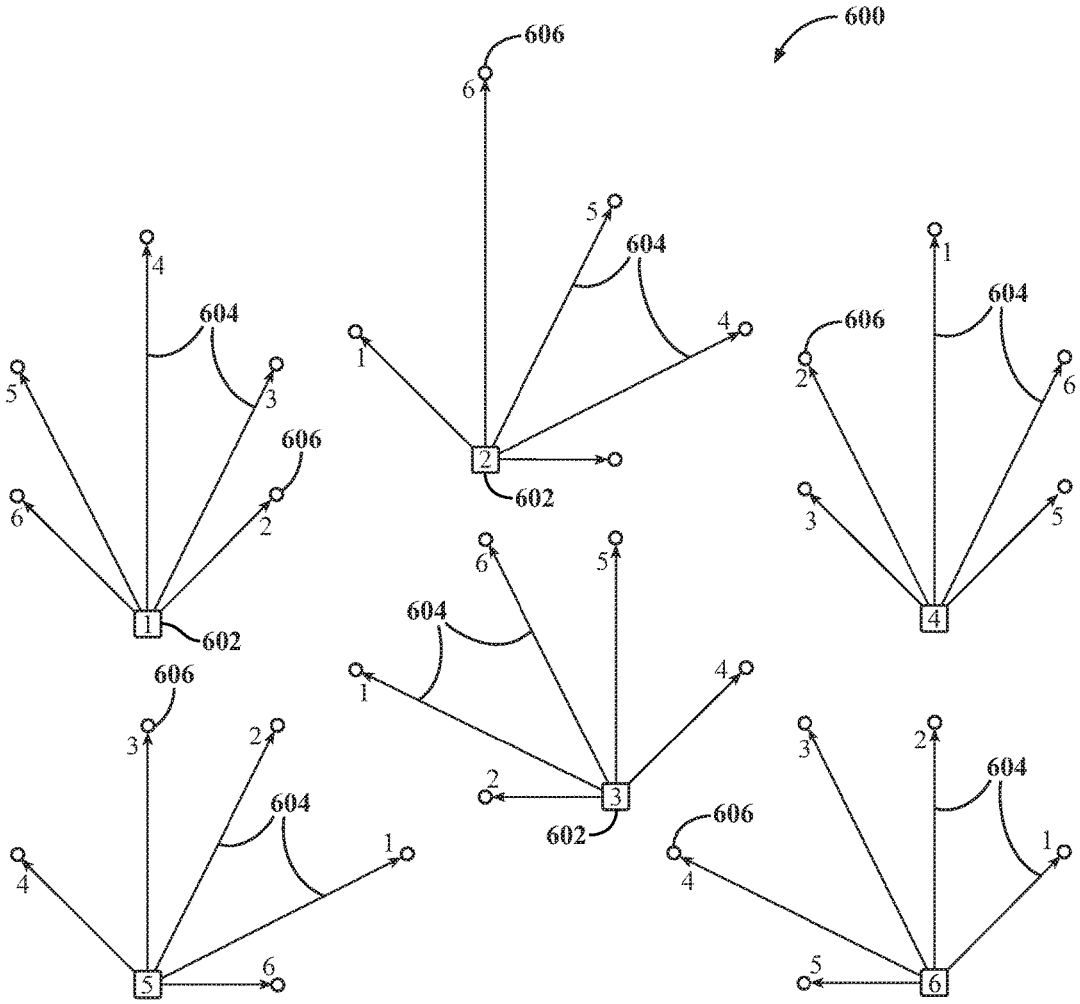
FIG. 6 is a two-dimensional diagram of microphone element position vectors for the exemplary network of loudspeakers.

Each of the microphones in the microphones arrays of the loudspeaker participants has a distance and 3-D direction vector to the stimulus loudspeaker participant, thereby identifying a location in 3-D space centered on each microphone (listening device). See FIG. 6 for diagram that shows a two-dimensional representation 600 of the loudspeaker participants 602 and position vectors 604 that depict the compiled results for each microphone. Each vector 604 is an output of the process described above as it relates to the entire array of microphones at the loudspeaker. Each vector 604(1-5) represents the output of the microphone array for a stimulus event at each other loudspeaker 602(1-6) in the plurality of loudspeakers. For example, speaker 602(1) as a measuring speaker shows vectors 604(2-6) which represent readings of the microphone array on speaker 602(1) as loudspeakers 602(2-6) emit their stimulus.

Referring back to FIG. 5, the position information is transmitted to the Coordinator, along with any additional sensor information such as temperature, pressure or orientation sensor data. The coordinator selects the next loudspeaker participant to generate the stimulus signal 502 and the steps 504-508 are repeated until all loudspeaker participants have had a turn generating the stimulus signal and all of the responses have been collected.

The results are compiled 510 by the coordinator. The coordinator now has data for a highly over-constrained geometric system. Each loudspeaker participant in an n-speaker system has n−1 position estimates. However, each estimate's absolute position is affected by an absolute position assigned to the loudspeaker participant that measured it. All of the position estimates need to be brought into a common coordinate system, also referred to as a global coordinate space, in such a way that the measurements captured from each position estimate harmonize with other measurements of the same stimulus. This amounts to an optimization problem where the objective function is to minimize the squared sum of the errors in measured positions v. assigned positions once all participants and measurements have been translated into the common coordinate system. In the algorithm, a greater confidence is assigned to the measured distances than is assigned to measured angles.

The compiled results are stored and distributed 512. Once an optimum set of positions has been compiled, the positions of each loudspeaker in the network are sent, as a group, to all of the participants in the network. Each loudspeaker participant stores its own position in the global coordinate space and translates updated positions from all other participants into its own local frame of reference for ease of use in any local calculations it may be asked to perform.

A management device, such as a personal computer, mobile phone or tablet, in communication with the loudspeaker network may be used to change the global coordinate system to better match a user of the system. For example, a translated set of coordinates may be communicated to the loudspeakers and the loudspeakers only need to update their own position, because the rest are stored relative to that.

A management device that docs not know current coordinates for the loudspeaker participants in the network may request the coordinator device provide coordinates in the current coordinate system. The coordinator will request that all loudspeaker participants in the network send their own coordinates, compile them into a list, and return it to the management device.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Measurements may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

The invention claimed is:

1. A network of loudspeaker components comprising:

a network interface having Audio-Video Bridging/Time Synchronized Network (AVB/TSN) capability;

a plurality of loudspeaker components in communication with the network interface, each loudspeaker component having an adjustable media clock source, a first array of microphone elements on a first plane, a second array of microphone elements on a second plane perpendicular to the first plane, and a speaker driver; and a processor having computer executable instructions for performing digital signal processing to generate and record an audio signal at each loudspeaker component, beamform recorded audio using at least one loudspeaker component, adjust and synchronize media clock sources, coordinate measurement procedures at each loudspeaker component, and compile results from the plurality of loudspeaker components to provide a common frame of reference and time base for each loudspeaker component in the plurality of loudspeaker components.

2. The network of loudspeaker components as claimed in claim 1 wherein each loudspeaker component further comprises one or more sensors for recording temperature, air pressure or orientation data.

3. The network of loudspeaker components as claimed in claim 1 wherein the first and second arrays of microphone elements further comprises a predefined geometric pattern for the microphone elements.

4. The network of loudspeaker components as claimed in claim 3 wherein the predefined geometric pattern is a circle.

5. The network of loudspeaker components as claimed in claim 1 wherein the loudspeaker components are arranged around a perimeter of a room.

6. The network of loudspeaker components as claimed in claim 5 wherein the loudspeaker components are arranged around a perimeter of a room in a convex polygon configuration with direct sound propagation paths between loudspeaker components.

7. A method for measurement and calibration of a time-synchronized network whose participants include loudspeaker participants, each loudspeaker participant has a plurality of microphone arrays, the method comprising the steps of:

determining a presence and capability of network participants and establish a priority of network participants;

electing a coordinator from the network participants based on the priority the coordinator establishing and advertising a media clock stream;

receiving the media clock stream at each network participant and each network participant synchronizing to the clock stream received from the coordinator and announcing synchronization to the coordinator;

designating at least one network participant to generate a stimulus signal and announce a precise time at which the stimulus signal is generated;

each network participant recording precise start and end timestamps of the stimulus signal and environment data collected as results;

compiling the results;

transmitting the results; and estimating locations of the loudspeaker participants within the network.

8. The method as claimed in claim 7 wherein the step of compiling the results further comprises the coordinator compiling the results received from other loudspeaker participants in the network to establish a global frame of reference for all of the loudspeaker participants in the network of participants.

9. The method as claimed in claim 8 wherein the step of transmitting further comprises transmitting positions of each loudspeaker participant in the network as a group to each loudspeaker participant in the network and each loudspeaker participant in the network storing its own position in a local frame of reference and in the global frame of reference.

10. The method as claimed in claim 7 wherein the step of compiling the results further comprises compiling the results locally at each loudspeaker participant to establish a local frame of reference for each loudspeaker participant.

11. The method as claimed in 10 wherein the step of compiling the results locally further comprises compiling the results for beamforming a response signal across the microphone array to determine an angle of arrival.

12. The method as claimed in claim 7 wherein the step of transmitting further comprises transmitting the results to a host system for calibrating the network.

13. The method as claimed in claim 7 further comprising the step of the coordinator storing the results.

14. The method as claimed in claim 7 wherein the loudspeaker participants are configured with predefined measurement procedures and the step of compiling results further comprises compiling results to configure data about particular loudspeaker participants or the network as a whole.

15. The method as claimed in claim 7 wherein the method is performed automatically.

16. The method as claimed in claim 7 wherein the method is performed in response to commands from a user interface device that is in communication with a network interface.

17. The method as claimed in claim 7 wherein the step of transmitting further comprises transmitting results to all of the loudspeaker participants in the network.

18. The method as claimed in claim 7 wherein the step of designating at least one network participant to generate a stimulus signal and announce a precise time at which the stimulus signal is generated further comprises designating each loudspeaker participant, in turn to generate a stimulus signal and announce a precise time at which the stimulus signal is generated.

19. The method as claimed in claim 18 wherein the method further comprises the steps of:

the loudspeaker participant responsible for generating the stimulus signal sends out a precise time stamp of its recording of the stimulus signal to all other loudspeaker participants, and recording, at each microphone array, the stimulus signal until the stimulus signal has been recorded by all microphone elements in the microphone arrays of all other loudspeaker participants.

20. The method as claimed in claim 18 wherein the step of compiling the results further comprises the steps of:

each loudspeaker participant determining a time in flight of the stimulus signal; and converting the time in flight to a distance value.

21. The method as claimed in claim 18 wherein the microphone arrays in each loudspeaker participant is a first microphone array in a first plane of the loudspeaker participant and a second microphone array in a second plane that is perpendicular to the first plane and at least one additional sensor, the method further comprising the steps of measuring a gravity vector direction with respect to at least one array of microphone elements using data from the at least one additional sensor.

22. The method as claimed in claim 21 wherein the step of compiling results further comprises determining an angle of arrival in each microphone array plane.

23. The method as claimed in claim 7 wherein the step of compiling further comprises the coordinator harmonizing each position estimate with other measurements from the same stimulus signal.

* * * * *